US005235323A

United States Patent [19]

Chien

[11] Patent Number: 5,235,323

[45] Date of Patent: Aug. 10, 1993

[54] FIRE ALARM WITH ELECTRIC AND NON-ELECTRIC ANNUNCIATORS

[76] Inventor: Lin H. Chien, No. 19, Alley 199, Charnge An St., Tai Tung City, Taiwan

[21] Appl. No.: 986,129

[22] Filed: Dec. 4, 1992

[51] Int. Cl.[5] ..... G08B 17/02

[52] U.S. Cl. ..... 340/590; 116/106; 340/577

[58] Field of Search ..... 340/577, 590; 116/106

[56] References Cited

U.S. PATENT DOCUMENTS 1,991,004 2/1935 Thacker, Jr. et al. ..... 116/106
2,085,860 7/1937 Lambert ..... 340/590
2,907,014 9/1959 Hollingsworth ..... 116/106
2,920,167 1/1960 Hill ..... 340/577
3,931,785 1/1976 Keeley et al. ..... 116/106

*Attorney, Agent, or Firm*—W. Wayne Liauh
*Primary Examiner*—Glen R. Swann, III

[57] ABSTRACT

A fire alarm which consists of a housing, an alarm assembly and a switch assembly. A driving spring in the alarm assembly is used for storing driving energy. As soon as a nylon string in the alarm is burnt and broken, the driving spring will drive small hammers to hit a bell cup to send out a warning signal to warn people that a fire is taking place. At the same time, a switch is closed to actuate an electric alarm to provide a persistent alarm as long as electric power is available.

3 Claims, 3 Drawing Sheets

FIRE ALARM WITH ELECTRIC AND NON-ELECTRIC ANNUNCIATORS

BACKGROUND OF THE INVENTION

Most of the conventional fire alarms can only send out a warning signal by means of either a commercial power or a dry battery so as to tell people that a fire is taking place.

However, such type of fire alarms would fail to send out a fire warning signal in case of outage of the commercial power or the dry battery being out of order; therefore, such fire alarms would consume a lot of electric power.

SUMMARY OF THE INVENTION

This invention relates to a fire alarm without using electric power, which comprises a housing, an alarm assembly and a switch assembly. The present invention uses a driving spring as a means to store driving energy, and a nylon string as a switch; as soon as the nylon string is burnt and broken, the driving spring will drive a small hammer to hit a bell cup to send out a sound signal to warn people that a fire is taking place. The prime object of the present invention is to provide a fire alarm without using electric power so as to save electric power, and to prevent the fire alarm from failure to function in case of power outage or a dry battery being out of order.

DETAILED DESCRIPTION

Figure 1:
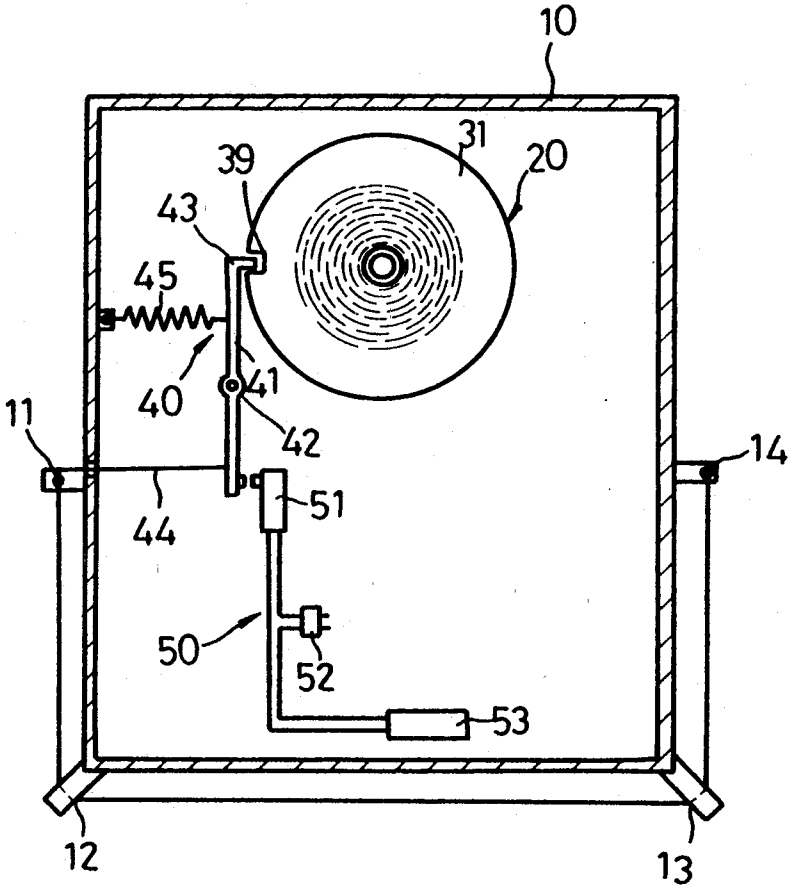
FIG. 1 is a front view of the inside structure of an embodiment according to the present invention.
Figure 2:
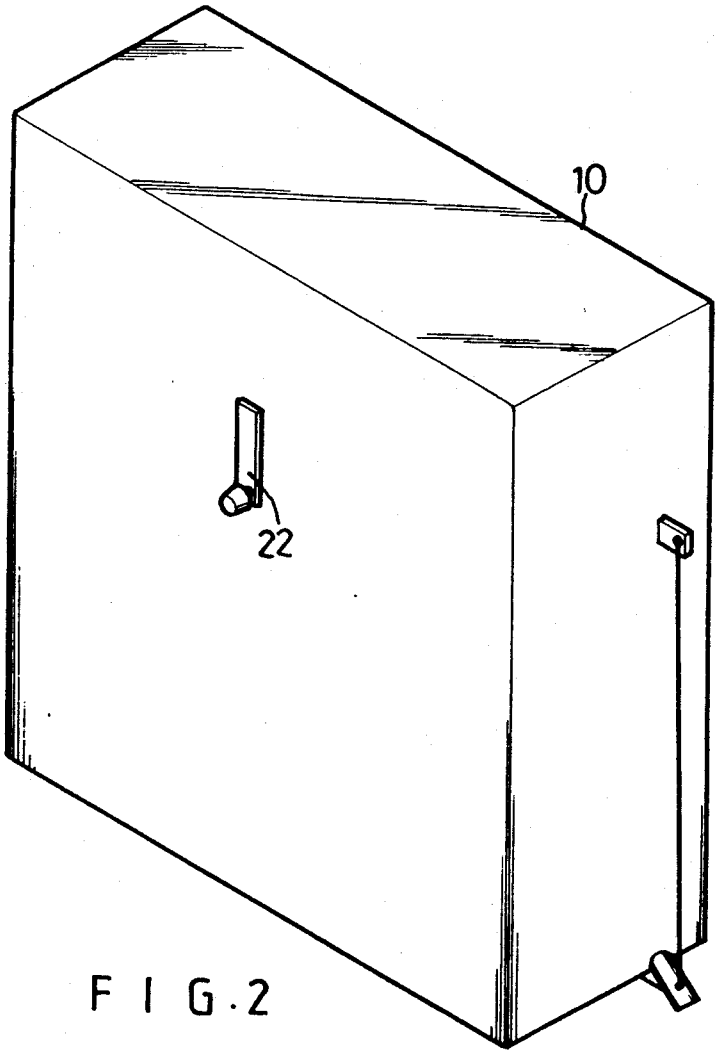
FIG. 2 is a perspective view of an embodiment according to the present invention.
Figure 3:
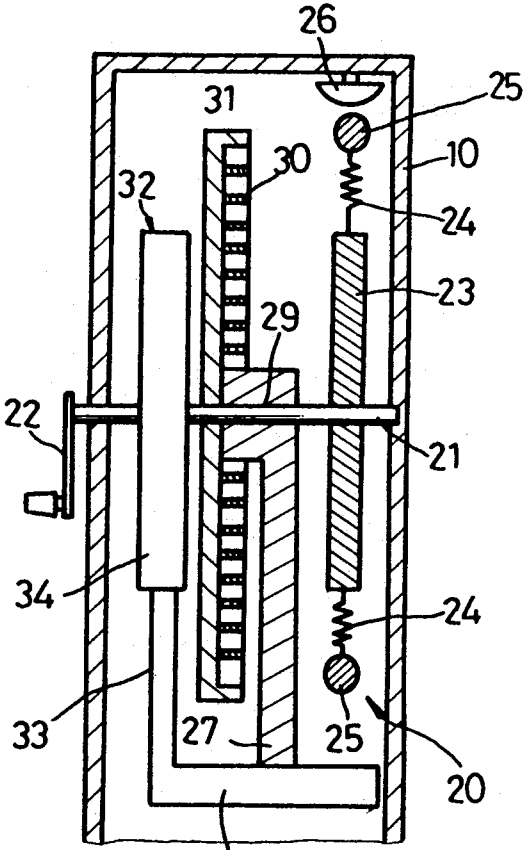
FIG. 3 is a side view of the present invention.
Figure 4:
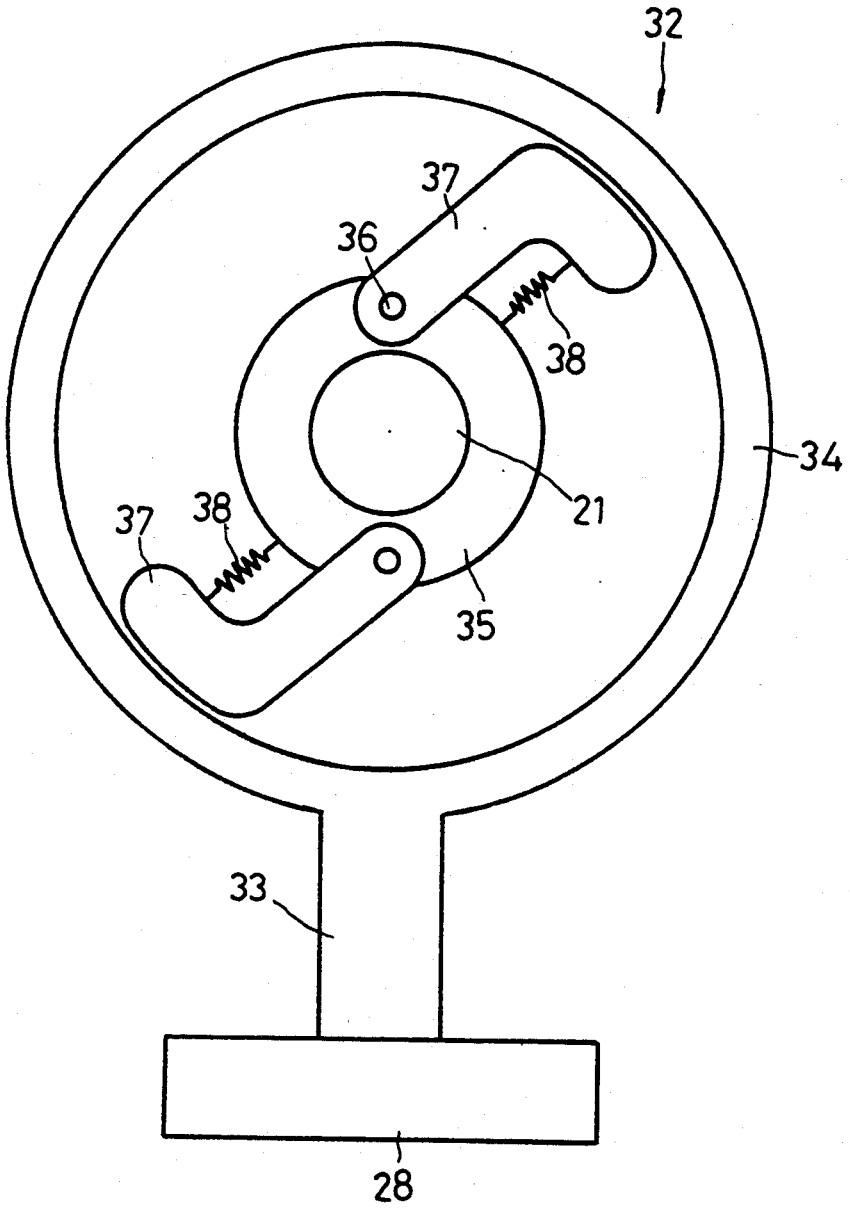
FIG. 4 is a front view of the speed regulator in the present invention.

Referring to FIGS. 1 and 2, the embodiment according to the present invention comprises a housing 10, an alarm assembly 20, and a switch assembly 40. The alarm assembly 20 (as shown in FIG. 3) is installed in the housing 10, and it includes a spindle 21, of which both ends are mounted and supported with the housing 10; the front end passes through the front wall of the housing 10; the front end of the spindle 21 is mounted with a crank 22. The spindle 21 can be turned by cranking the crank 22. A fixed rod 23 is mounted on the spindle 21 in a symmetrical and equal length manner. Both ends of the fixed rod 23 are mounted with two springs 24 and two small hammers 25 respectively. A bell cup 26 is fixedly mounted within the housing 10 on the opposite side of the small hammer 25 with a given gap therebetween. When the spindle 21 is rotated, the small hammer 25 will hit the bell cup 26 as a result of the centrifugal force. A fixing base 27 is fixed beside the fixed rod 23, and is mounted on a base 28, which is fixed to the housing 10. The fixing base 27 has a spindle hole 29 for receiving the spindle 21. The top end of the fixing base 27 is mound with a driving spring 30, of which the inner end is fixed to the fixing base 27, while the outer end thereof is fixed to a rotary disc 31, which is fixedly mounted beside the driving spring 30 to turn synchronously with the spindle 21. A speed regulator 32 (as shown in FIG. 4) is mounted by the side of the rotary disc 31, and it is fixed to a fixing base 33 connected to the base 28. The speed regulator 32 includes a round drum 34 fixedly connected with the fixing base 33; a spindle 21 is mounted through the center hole of the round drum 34, and is fixedly mounted with a bushing 35. Both the top and bottom sides of the bushing 35 are pivotally mounted with two friction blocks 37 respectively, of which the outer ends each is connected with the bushing 35 through a spring 38 so as to pull the friction block 37 towards the bushing 35 normally, and to maintain a gap between the friction block 37 and the round drum 34. When the spindle 21 rotates at a higher speed, the friction blocks 37 will be thrown away from the spindle as a result of the centrifugal force; in that case, the friction blocks 37 would touch the inner surface of the round drum 34 to cause a friction, which will cause the spindle 21 to reduce rotation speed so as to have the spindle 21 maintained at a slow and steady rotating speed.

The switch assembly 40 mounted in the housing 10 includes a detent arm 41, which is pivotally mounted, with a pin 42, to the housing 10 as a fulcrum. The top of the detent arm 41 has a pawl 43 to be engaged with a catching cut 39 on the outer surface of the rotary disc 31 of the alarm assembly 20. The lower end of the detent arm 41 is attached with nylon string 44, which passes through the housing 10 and several fixed pins 11, 12, 13 and 14 on the outer surface of the housing 10. The rear end of the nylon string 44 is fastened to the fixed pin 14. Between the pawl 43 of the detent arm 41 and the pin 42, a pulling spring 45 is attached, while the other end of the spring 45 is hooked to the housing 10; however, the pulling force of the spring 45 to the detent arm 41 is slightly smaller than that of the nylon string 44 so as to have the pawl 43 engaged normally in the catching cut 39 of the rotary disc 31.

The present invention in real use is also to be attached to the ceiling of a room by means of the housing 10; the driving spring 30 should be pre-wound fully by using the crank 22 and the spindle 21 so as to have the driving spring 30 stored a driving energy able to drive the spindle 21 and the rotary disc 31 to turn, if necessary; normally, the rotary disc 31 and the spindle 21 can not be rotated as a result of the rotary disc 31 being retained by the detent arm 41. In case of a fire taking place, the nylon string 44 will be burnt and broken by a high temperature; in such case, the pawl 43 of the detent arm 41 will become disengaged from the rotary disc 31 as a result of the pulling force of the pulling spring 45; as soon as the pawl 43 is disengaged from the catching cut 39, the rotary disc 31 and the spindle 21 will be driven by the driving spring 30 to turn; almost simultaneously, the fixed rod 23 on the spindle 21 will also turn, and the small hammers 25 on both ends thereof will hit the bell cup 26 as a result of the centrifugal force thereof. The sound of the bell cup 26 would warn people that a fire takes place. Since spindle 21 is mounted with a speed regulator 32, the rotation speed of the spindle 21 will be retarded so as to let the sound of the bell cup have a longer duration; otherwise, the sound of the bell cup will disappear soon.

The duration of the bell sound may be increased by installing a bell sound duration assembly 50, which includes a touch switch 51 mounted on the lower end of the detent arm 41; the touch switch 51 is connected with a commercial power supply by using a plug 52. In case of the nylon string being broken, the lower end of the detent arm 41 will hit the touch switch 51, which will be turned on immediately to trigger an electric alarm 53; the electric alarm 53 can provide a continuous alarm after the sound of bell cup 26 is discontinued.

I claim:

1. A fire alarm comprising:

a housing;

an alarm assembly mounted in said housing, said alarm assembly including a spindle mounted horizontally in said housing; the front end of said spindle being fastened to a crank, while the rear end thereof is fastened to a fixed rod, each end of said rod mounting two springs and two small hammers respectively; a bell cup fastened to said housing opposite said small hammers; a fixing base mounted beside said fixed rod, the top of said fixing base being mounted with a driving spring, of which one end is fastened to said fixing base, while the other end thereof is fastened to a rotary disc which is fixed to said spindle so as to turn the spindle a speed regulator being mounted beside said rotary disc to provide a retarding function;

a switch assembly mounted in said housing and including a detent arm being pivotally fastened to said housing as a fulcrum; the top of said detent arm having a pawl to be engaged with a catching cut on said rotary disc; a pulling spring being attached to the upper part of said detent arm, while the other end of said pulling spring is attached to said housing, and said pulling spring being used for pulling said pawl out of said catching cut; the lower end of said detent arm being fastened with a nylon string to pull said detent arm so as to have said pawl engaged in said catching cut; the other end of said nylon string passing through said housing and a plurality of fixed pins on the outer surface of said housing; and said driving spring being able to be wound for storing driving power by turning said crank; said detent arm of said switch assembly normally preventing said rotary disc from turning, and in case of a fire taking place, said nylon string being broken by fire, and simultaneously said detent arm and said pawl being pulled away from said rotary disc by said pulling spring, and said driving spring driving said fixed rod to turn, whereby said small hammers hit said bell cup as a result of centrifugal force to send out a warning signal.

2. A fire alarm as claimed in claim 1, wherein said speed regulator includes a round drum mounted on a fixing base, said spindle passing through said drum and mounting a bushing, there being pivotally attached to said bushing two symmetrical friction blocks by using two pins respectively; each said friction block being pulled to said bushing with a spring; whereby when said spindle rotates at a high speed, said friction blocks move outwards as a result of a centrifugal force to touch the inner surface of said round drum so as to retard the rotating speed of said spindle.

3. A fire alarm as claimed in claim 1, wherein said detent arm is mounted with a bell sound duration assembly, which includes a touch switch, a plug connected with a commercial power supply and an electric alarm; whereby in the event of said nylon strings being broken, said detent arm causes said touch switch to turn on so as to trigger said electric alarm.

* * * * *